US008882227B2

(12) United States Patent
Sato et al.

(10) Patent No.: US 8,882,227 B2
(45) Date of Patent: Nov. 11, 2014

(54) LIQUID DISCHARGE APPARATUS

(71) Applicant: Seiko Epson Corporation, Tokyo (JP)

(72) Inventors: Akito Sato, Matsumoto (JP); Satoshi Yamazaki, Matsumoto (JP); Keiko Yamada, Shiojiri (JP); Yuko Yamamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/084,508

(22) Filed: Nov. 19, 2013

(65) Prior Publication Data

US 2014/0139580 A1 May 22, 2014

(30) Foreign Application Priority Data

Nov. 20, 2012 (JP) ..... 2012-253932

(51) Int. Cl.
*B41J 2/07* (2006.01)

(52) U.S. Cl.
CPC ..... *B41J 2/07* (2013.01)
USPC ..... 347/14; 347/23; 347/35

(58) Field of Classification Search
CPC ..... B41J 2/07; B41J 2/16526; B41J 2/1652; B41J 3/543; B41J 29/38; B41J 29/393; B41J 2/16517
USPC ..... 347/9, 12, 14, 22, 23, 29, 34, 35, 60
See application file for complete search history.

(56) References Cited

U.S. PATENT DOCUMENTS

| | | | | |
|---|---|---|---|---|
| 7,802,867 | B2 | 9/2010 | Sakurai | |
| 8,287,087 | B2 | 10/2012 | Sano | |
| 8,662,635 | B2 * | 3/2014 | Yuda et al. | 347/35 |

FOREIGN PATENT DOCUMENTS

| | | | |
|---|---|---|---|
| JP | 2009-039868 | A | 2/2009 |
| JP | 2010-105306 | A | 5/2010 |
| JP | 2011-143623 | A | 7/2011 |

* cited by examiner

*Primary Examiner* — Thinh Nguyen
(74) *Attorney, Agent, or Firm* — Kilpatrick Townsend & Stockton LLP

(57) ABSTRACT

A liquid discharge apparatus, comprising: a transportation unit that transports a medium; a head that includes a first nozzle array on which nozzles for discharging a first liquid are arrayed, and a second nozzle array on which nozzles for discharging a second liquid are arrayed; and a controller that controls the transportation unit and the head based on print data, wherein, in a case where the printing of the print data is designated to be performed without forming the printing dots of the first liquid on the medium, the controller causes the head to discharge the second liquid from the second nozzle array to form the printing dots of the second liquid on the medium, and causes the head to discharge the first liquid from the first nozzle array to form the flushing dots of the first liquid on the medium.

9 Claims, 8 Drawing Sheets

FIG. 2

| NUMBER OF PAGES | SHEET WIDTH | SHEET SURFACE FL | | NON-SHEET SURFACE FL | |
|---|---|---|---|---|---|
| | | COLOR INK | BLACK INK | COLOR INK | BLACK INK |
| 1 TO 3 | — | (A-1) NOT PERFORMED | (A-4) NOT PERFORMED | (A-7) NOT PERFORMED | (A-10) NOT PERFORMED |
| FROM 4 | WIDE (ENTIRE COLUMN WIDTH) | (A-2) PERFORMED | (A-5) PERFORMED | (A-8) NOT PERFORMED | (A-11) NOT PERFORMED |
| | NARROW (PART OF COLUMN WIDTH) | (A-3) PERFORMED | (A-6) PERFORMED | (A-9) PERFORMED | (A-12) PERFORMED |

FL IN CASE WHERE TRANSPORTATION SPEED IS FAST IN MONOCHROME PRINTING

FIG. 3

| NUMBER OF PAGES | SHEET WIDTH | SHEET SURFACE FL | | NON-SHEET SURFACE FL | |
|---|---|---|---|---|---|
| | | COLOR INK | BLACK INK | COLOR INK | BLACK INK |
| 1 | — | (B-1) NOT PERFORMED | (B-4) PERFORMED | (B-7) NOT PERFORMED | (B-10) NOT PERFORMED |
| PLURAL | WIDE (ENTIRE COLUMN WIDTH) | (B-2) PERFORMED | (B-5)PERFORMED | (B-8) NOT PERFORMED | (B-11) NOT PERFORMED |
| | NARROW (PART OF COLUMN WIDTH) | (B-3) PERFORMED | (B-6) PERFORMED | (B-9) PERFORMED | (B-12) PERFORMED |

FL IN CASE WHERE TRANSPORTATION SPEED IS USUAL IN MONOCHROME PRINTING

FIG. 4

| NUMBER OF PAGES | SHEET WIDTH | SHEET SURFACE FL | | NON-SHEET SURFACE FL | |
|---|---|---|---|---|---|
| | | COLOR INK | BLACK INK | COLOR INK | BLACK INK |
| 1 | WIDE (ENTIRE COLUMN WIDTH) | (C-1) PERFORMED | (C-5) PERFORMED | (C-9) NOT PERFORMED | (C-13) NOT PERFORMED |
| | NARROW (PART OF COLUMN WIDTH) | (C-2) PERFORMED | (C-6) PERFORMED | (C-10) PERFORMED | (C-14) PERFORMED |
| PLURAL | WIDE (ENTIRE COLUMN WIDTH) | (C-3) PERFORMED | (C-7) PERFORMED | (C-11) PERFORMED, HOWEVER, PERFORMED LESS THAN IN (C-12) | (C-15) PERFORMED, HOWEVER, PERFORMED LESS THAN IN (C-16) |
| | NARROW (PART OF COLUMN WIDTH) | (C-4) PERFORMED | (C-8) PERFORMED | (C-12) PERFORMED, HOWEVER, PERFORMED MORE THAN IN (C-11) | (C-16) PERFORMED, HOWEVER, PERFORMED MORE THAN IN (C15) |

FL IN CASE WHERE TRANSPORTATION SPEED IS SLOW IN MONOCHROME PRINTING

FIG. 5

| NUMBER OF PAGES | SHEET WIDTH | SHEET SURFACE FL | | NON-SHEET SURFACE FL | |
|---|---|---|---|---|---|
| | | COLOR INK | BLACK INK | COLOR INK | BLACK INK |
| 1 TO 3 | — | (A-101) NOT PERFORMED | (A-104) PERFORMED | (A-107) NOT PERFORMED | (A-110) NOT PERFORMED |
| FROM 4 | WIDE (ENTIRE COLUMN WIDTH) | (A-102) PERFORMED | (A-105) PERFORMED | (A-108) NOT PERFORMED | (A-111) NOT PERFORMED |
| | NARROW (PART OF COLUMN WIDTH) | (A-103) PERFORMED | (A-106) PERFORMED | (A-109) PERFORMED, HOWEVER, PERFORMED MORE THAN IN MONOCHROME PRINTING | (A-112) PERFORMED, HOWEVER, PERFORMED MORE THAN IN MONOCHROME PRINTING |

FL IN CASE WHERE TRANSPORTATION SPEED IS FAST IN COLOR PRINTING

FIG. 6

| NUMBER OF PAGES | SHEET WIDTH | SHEET SURFACE FL | | NON-SHEET SURFACE FL | |
|---|---|---|---|---|---|
| | | COLOR INK | BLACK INK | COLOR INK | BLACK INK |
| 1 | — | (B-101) NOT PERFORMED | (B-104) PERFORMED | (B-107) NOT PERFORMED | (B-110) NOT PERFORMED |
| PLURAL | WIDE (ENTIRE COLUMN WIDTH) | (B-102) PERFORMED | (B-105) PERFORMED | (B-108) NOT PERFORMED | (B-111) NOT PERFORMED |
| | NARROW (PART OF COLUMN WIDTH) | (B-103) PERFORMED | (B-106) PERFORMED | (B-109) PERFORMED, HOWEVER, PERFORMED MORE THAN IN MONOCHROME PRINTING | (B-112) PERFORMED, HOWEVER, PERFORMED MORE THAN IN MONOCHROME PRINTING |

FL IN CASE WHERE TRANSPORTATION SPEED IS USUAL IN COLOR PRINTING

FIG. 7

| NUMBER OF PAGES | SHEET WIDTH | SHEET SURFACE FL | | NON-SHEET SURFACE FL | |
|---|---|---|---|---|---|
| | | COLOR INK | BLACK INK | COLOR INK | BLACK INK |
| 1 | WIDE (ENTIRE COLUMN WIDTH) | (C-101) PERFORMED | (C-105) PERFORMED | (C-109) NOT PERFORMED | (C-113) NOT PERFORMED |
| | NARROW (PART OF COLUMN WIDTH) | (C-102) PERFORMED | (C-106) PERFORMED | (C-110) PERFORMED, HOWEVER, PERFORMED MORE THAN IN MONOCHROME PRINTING | (C-114) PERFORMED, HOWEVER, PERFORMED MORE THAN IN MONOCHROME PRINTING |
| PLURAL | WIDE (ENTIRE COLUMN WIDTH) | (C-103) PERFORMED | (C-107) PERFORMED | (C-111) PERFORMED, HOWEVER, PERFORMED MORE THAN IN MONOCHROME PRINTING AND LESS THAN IN (C-112) | (C-115) PERFORMED, HOWEVER, PERFORMED MORE THAN IN MONOCHROME PRINTING AND LESS THAN IN (C-116) |
| | NARROW (PART OF COLUMN WIDTH) | (C-104) PERFORMED | (C-108) PERFORMED | (C-112) PERFORMED, HOWEVER, PERFORMED MORE THAN IN MONOCHROME PRINTING AND MORE THAN IN (C-111) | (C-116) PERFORMED, HOWEVER, PERFORMED MORE THAN IN MONOCHROME PRINTING AND MORE THAN IN (C-115) |

FL IN CASE WHERE TRANSPORTATION SPEED IS SLOW IN COLOR PRINTING

LIQUID DISCHARGE APPARATUS

CROSS-REFERENCE TO RELATED APPLICATIONS

This application claims priority to Japanese Patent Application No. 2012-253932 filed on Nov. 20, 2012. The entire disclosure of Japanese Patent Application No. 2012-253932 is hereby incorporated herein by reference.

BACKGROUND

1. Technical Field

The present invention relates to a liquid discharge apparatus.

2. Related Art

In an ink jet type line printer which is capable of printing in color, in order to prevent ink in a nozzle from thickening in a printing head, and to maintain good discharge performance, a flushing is performed whereby ink drops are discharged from the nozzle periodically as disclosed in JP-A-2010-105306. In such a flushing, a method is known, in which flushing is performed with the nozzle port of the printing head facing a cap, in a maintenance position away from the printing area.

However, for example, since a color ink is not used at the time of monochrome printing, the color ink thickens in the nozzle, and the discharge of the color ink becomes unreliable at the time of the color printing, thus there has been a case where the print quality deteriorates. In addition, in a case of flushing, since the cap is required to face the nozzle, the moving operation or opening and closing operation of each cap is necessary, and the control of the cap becomes complicated. In addition, since the flushing is performed by switching the cap, the required time for performing the flushing by switching the nozzle becomes long. Therefore, printing throughput deteriorates.

SUMMARY

The invention can be realized in the following forms or application examples.

Application Example 1

In a liquid discharge apparatus according to this application example, the liquid discharge apparatus includes: a transportation unit that transports a medium; a head that includes a first nozzle array on which nozzles for discharging a first liquid are arrayed in a direction crossing the direction in which the medium is transported, and a second nozzle array on which nozzles for discharging a second liquid are arrayed in the crossing direction; a cap that opens and closes the first nozzle array and the second nozzle array; and a controller that controls the transportation unit, the head, and the cap based on print data. In a case where the printing of the print data is designated to be performed without forming the printing dots of the first liquid on the medium, the controller causes the cap to be opened with respect to the first nozzle array and the second nozzle array, causes the head to discharge the second liquid from the second nozzle array to form the printing dots of the second liquid on the medium, and causes the head to discharge the first liquid from the first nozzle array to form the flushing dots of the first liquid on the medium.

According to such a configuration, the controller controls the opening and the closing of the cap of the first nozzle array and the second nozzle array, and in a case where the printing of the print data is designated to be performed without forming the printing dots of the first liquid on the medium, causes the caps of the first nozzle array and the second nozzle array to be opened, to form the printing dots of the second liquid and the flushing dots of the first liquid. Therefore, even in a case where the printing of the print data is designated to be performed without forming the printing dots of the first liquid on the medium, the flushing is performed by the first nozzle array. Thus, it is possible to avoid the thickening of the first liquid. Furthermore, in a case where the printing of the print data is designated to be performed without forming the printing dots of the first liquid on the medium, since the cap is opened with respect to the first nozzle array and the second nozzle array, it is possible to easily control the caps. In addition, by forming the flushing dots on the medium, the flushing is performed by the first nozzle array. Accordingly, it is possible improve a printing throughput of the print data compared to the case where flushing is performed along with the opening and closing of the cap.

Application Example 2

In the liquid discharge apparatus according to the application example described above, in a case where the printing of the print data is designated to be performed without forming the printing dots of the first liquid on the medium and the number of pages designated to be printed is equal to or less than the predetermined number, the controller may not cause the flushing dots of the first liquid to be formed on the medium.

According to such a configuration, even in a case where the printing of the print data is designated to be performed without forming the printing dots of the first liquid on the medium, if the number of pages is equal to or less than the predetermined number, the flushing dots of the first liquid are not formed on the medium. Accordingly, it is possible to reduce the influence by the flushing dots affecting the print result.

Application Example 3

In the liquid discharge apparatus according to the application example described above, the second liquid may have characteristics of containing an amount of moisture less than that of the first liquid, and in a case where the printing of the print data is designated to be performed without forming the printing dots of the first liquid on the medium and the number of pages designated to be printed is equal to or less than the predetermined number, the controller may cause the flushing dots of the second liquid to be formed on the medium.

According to such a configuration, the flushing can be performed respectively in an appropriate timing according to the difference of the characteristics of the first liquid and the characteristics of the second liquid. Accordingly, even when the first liquid more easily thickens than the second liquid, it is possible to avoid the thickening of the first liquid.

Application Example 4

In the liquid discharge apparatus according to the application example described above, the controller may not cause the flushing dots of the first liquid to be formed on the medium of at least immediately before closing the cap with respect to the first nozzle array and the second nozzle array.

According to such a configuration, by closing cap with respect to the first nozzle array and the second nozzle array, the progress of the thickening can be reduced. In addition, with regard to the medium at least immediately before closing the cap, it is possible to reduce the influence in which the flushing dots may have an affection on the print result. Moreover, the number of media on which the flushing dots are not formed is not necessarily limited to be one, but may be a plural number. In addition, after closing the cap, the liquid may or may not be discharged on the cap.

Application Example 5

In the liquid discharge apparatus according to the application example described above, the controller may control a first flushing in which the flushing dots are formed on the medium by causing the head to discharge the liquid toward the medium and a second flushing which causes the head to discharge the liquid toward a non-medium.

According to such a configuration, the controller can control each flushing according to the designated printing. In a case where the first nozzle array and the second nozzle array are in the position of forming the dots on the medium, the printing throughput of the print data can be improved when the first flushing is performed compared to the case of the second flushing. In addition, it is possible to reduce the influence in which the flushing dots may have an affection on the print result when the second flushing is performed compared to the case of the first flushing.

Application Example 6

In the liquid discharge apparatus according to the application example described above, the controller may selectively control the first flushing and the second flushing, a proportion of an amount of liquid discharged by the second flushing with respect to an amount of liquid discharged by the first flushing in a case where the printing for a first medium is designated to be performed, may be larger than a proportion of an amount of liquid discharged by the second flushing with respect to an amount of liquid discharged by the first flushing in a case where the printing for a second medium is designated to be performed, and a size of the first medium in the crossing direction may be smaller than that of the second medium, and sizes of the both media in the transportation direction may be the same.

According to such a configuration, the control of the first flushing and the second flushing can be changed according to the size of the printed medium. In the case of the first medium, the amount of liquid discharged by the second flushing is relatively large, thus, it is possible to reduce the influence in which the flushing dots may have an affection on the print result. In addition, in case of the second medium, the amount of liquid discharged by the first flushing is relatively large, thus, the printing throughput of the print data can be improved. Moreover, in the case of selective control, both of the first flushing and the second flushing should not be performed at the same time.

Application Example 7

In the liquid discharge apparatus according to the application example described above, the controller may change the control of forming the flushing dots according to a speed at which the medium is transported.

According to such a configuration, for example, by comparing the cases where the transportation speed of the medium is relatively fast and relatively slow, it is possible to change the control; (1) whether the flushing dots are formed on the medium or not, (2) whether the amount of liquid discharged of the second flushing relatively is small or relatively is large with respect to the amount of liquid discharged of the first flushing, in a case where the first flushing by which the flushing dots are formed on the medium and the second flushing by which the liquid is discharged on the non-medium are performed.

Application Example 8

In the liquid discharge apparatus according to the application example described above, the controller may be capable of designating whether the printing of the print data is performed in a first mode or in a second mode, the first mode may be a mode in which the printing dots of the second liquid are formed on the medium while the printing dots of the first liquid are not formed on the medium, and the second mode is a mode in which the printing dots of the first liquid may be formed on the medium and the printing dots of the second liquid are formed on the medium.

According to such a configuration, it is possible to easily designate the liquid which forms the printing dots on the medium.

BRIEF DESCRIPTION OF THE DRAWINGS

The invention will be described with reference to the accompanying drawings, wherein like numbers reference like elements.

FIG. 2 is a diagram illustrating a flushing condition in a case where a sheet transportation speed is faster than usual, in the monochrome printing.

FIG. 3 is a diagram illustrating a flushing condition in a case where the sheet transportation speed is as usual, in the monochrome printing.

FIG. 4 is a diagram illustrating a flushing condition in a case where a sheet transportation speed is slower than usual, in the monochrome printing.

FIG. 5 is a diagram illustrating a flushing condition in a case where a sheet transportation speed is faster than usual, in the color printing.

FIG. 6 is a diagram illustrating a flushing condition in a case where the sheet transportation speed is as usual, in the color printing.

FIG. 7 is a diagram illustrating a flushing condition in a case where a sheet transportation speed is slower than usual, in the color printing.

DESCRIPTION OF EXEMPLARY EMBODIMENTS

Embodiment

Figure 1:
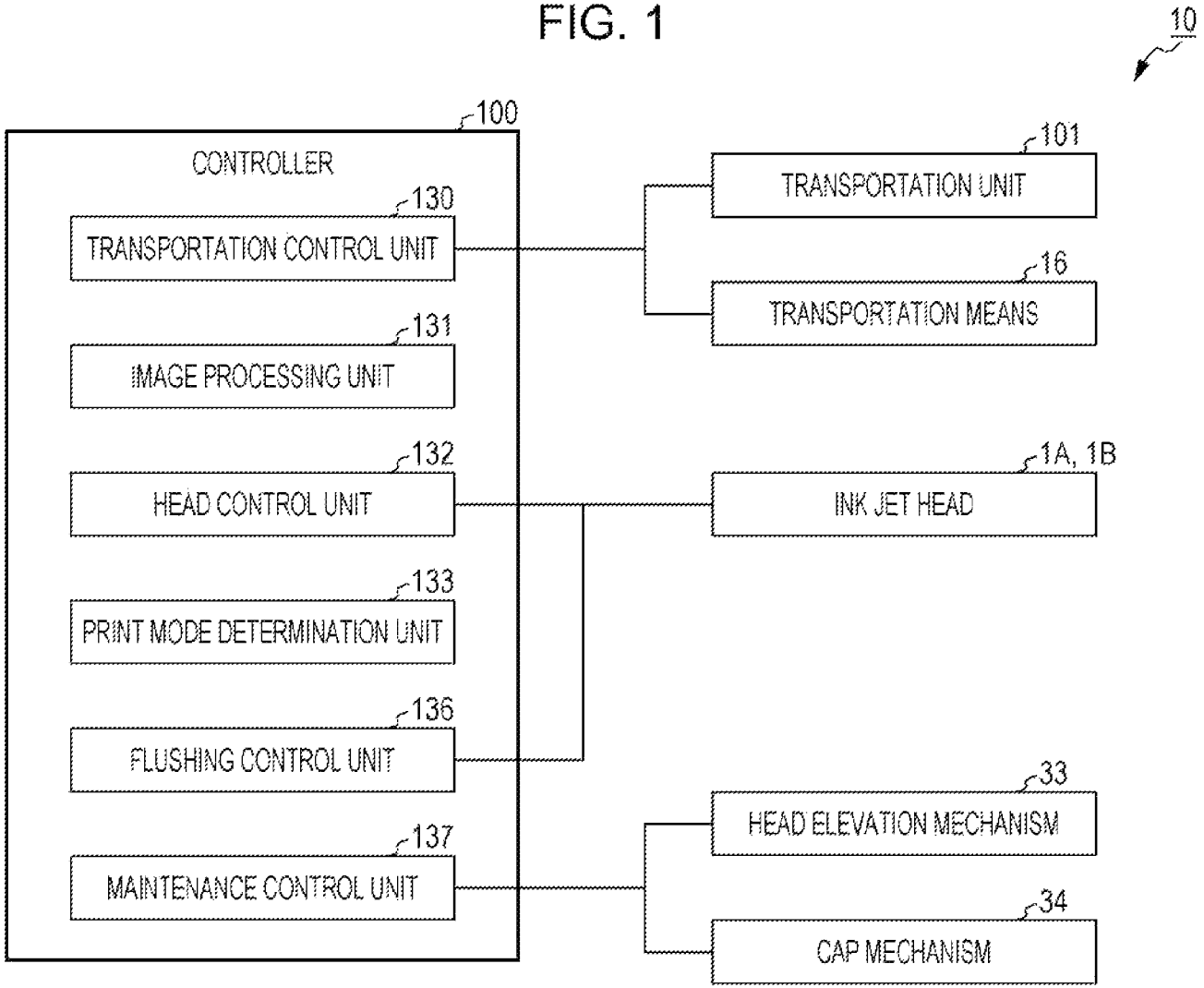
FIG. 1 is a schematic configuration diagram according to an embodiment of the invention.

In the embodiment, a line printer 10 illustrating schematic configuration in FIG. 1 is assumed to be used as a liquid discharge apparatus. The line printer 10 is a printing apparatus that performs printing by discharging drops of ink onto a sheet which is a medium from a plurality of nozzles on the ink jet head included in the line head. The line head is a head for printing on which the nozzles are disposed over the entire width direction of the sheet so as to be capable of printing without scanning in a width direction of the sheet (main scanning direction).

In the embodiment, the line head includes an ink jet head 1A (FIG. 1) having a black nozzle array that discharges black (K) ink drops, and an ink jet head 1B (FIG. 1) having a color nozzle array that discharges cyan (C), magenta (M), and yellow (Y) ink drops respectively. These ink jet heads (1A and 1B) have the same structure and extend along the main scanning direction, and are disposed in parallel and in the same interval to each other in the sub scanning direction in which the sheet is transported by crossing the main scanning direction. The bottom surfaces of the ink jet heads 1A and 1B have discharge surfaces on which a plurality of nozzle ports are arrayed. Here, the ink jet heads 1A and 1B are not limited to be separate one, but may be integrated as one.

The line printer 10 includes an ink cartridge and printing head which are not illustrated, as hardware for performing the printing.

In addition, the line printer 10 includes a CPU, RAM, ROM, a flash memory, an operation panel, and an interface which are not illustrated, as hardware for controlling the printing. The CPU reads out a program stored in the ROM and the flash memory to the RAM, and executes the program.

The line printer 10 includes a controller 100 that controls the print processing. The controller 100 includes a transportation control unit 130, an image processing unit 131, a head control unit 132, a print mode determination unit 133, a flushing control unit 136, and a maintenance control unit 137. These functional units realize the functions by the hardware and software described above by working together.

The transportation control unit 130 controls the operation of a transportation unit 101 that extracts the sheet one by one from a plurality of sheets accommodated in a (not illustrated) sheet feed tray in a laminated state, and the operation of a transportation unit 16 that transports the extracted sheets along the transportation direction. Here, an endless belt that sends the sheet to the transportation direction according to the rotation of the transportation motor is assumed to be used as the transportation unit 16.

The print mode determination unit 133 analyzes image print data transmitted from a (not illustrated) host computer connected to the line printer 10, and determines any of the color print mode that forms the printing dots for CMYK on the sheet using the CMYK ink, and the monochrome print mode that forms the printing dots for black on the sheet using the black ink.

The image processing unit 131 converts the print data (CMYK data) into the dot arrangement pattern of each ink by performing the half-tone (H/T) processing according to any of the determined mode: the color print mode or the monochrome print mode. Furthermore, the image processing unit 131 generates discharge data as dot data for each ink, based on the dot arrangement pattern.

The head control unit 132 causes the desired volume of ink drops to be discharged in a desired timing by causing each of the ink jet heads 1A and 1B to operate based on the discharge data.

In addition, in a case where the print mode determination unit 133 determines to perform the color print mode, the head control unit 132 operates all of the ink jet heads 1A and 1B, based on the discharge data generated by the image processing unit 131. On the other hand, in a case where the print mode determination unit 133 determines to perform the monochrome print mode, the head control unit 132 operates the ink jet head 1A that discharges the black ink drops, based on the discharge data generated by the image processing unit 131.

The flushing control unit 136 controls each ink jet head 1A and 1B such that the discharge flushing which causes the ink drops to be discharged from the discharge port of each ink jet head 1A and 1B is performed. Here, if one ink drop discharged onto the sheet from the discharge port is extremely small, even when the ink drop lands on the sheet, for example, the ink drop is hardly recognized by the eyes.

In the embodiment, it is assumed that there are two kinds of discharge flushing: a first flushing (hereafter, called sheet surface FL) in which the ink drop is discharged with respect to the sheet and forms flushing dots on the sheet, and a second flushing (hereafter called non-sheet surface FL) in which the ink is discharged with respect to non-sheet (non-medium) such as a cap or other members.

The maintenance control unit 137, in a case where the discharge flushing is performed, controls the vertical movement operation of the ink jet heads 1A and 1B by a head elevation mechanism 33, and the opening and closing operation of the cap (illustration omitted) by a cap mechanism 34. Moreover, in the embodiment, at the time of non-sheet FL, since an operation for making the ink jet heads 1A and 1B to move upward from the print position is required, longer time is required than at the time of sheet surface FL on the print position.

In addition, in the embodiment, in a case where the cap is an elastic member having a concave portion, and is instructed to perform a closing operation, by the distal end of the concave portion coming in contact with the ink jet heads 1A and 1B, all of the CMYK discharge port can collectively be covered. On the other hand, in a case where the cap is instructed to perform an opening operation, the elastic member which comes in contact with the discharge surface is retracted, and the cap can collectively be opened with respect to all of the CMYK. When the cap is opened, the ink drops of CMYK discharged from the discharge port can arrive at the sheet. Moreover, the elastic members are separately formed as the elastic members of CMYK discharge port and K discharge port, and by the elevation operation of the ink jet heads 1A and 1B being commonly performed, the aspect of collectively performing all of the CYMK operation of the cap can be assumed.

The controller 100 having each function unit described above, in a case where the print mode determination unit 133 determines to perform the monochrome print mode, in order to avoid the thickening of the CMYK ink (color ink) according to the predetermined condition, instructs the flushing control unit 136 and the maintenance control unit 137 to perform the sheet surface FL by the color ink from the ink jet head 1B.

That is, any of the CMYK ink can be arrived at the sheet from the ink jet heads 1A and 1B by opening the cap, the controller 100 causes the ink jet heads 1A to operate based on the discharge data generated by the image processing unit 131, and causes the black ink drops to be discharged to form the printing dots on the sheet. Furthermore, based on the predetermined flushing data, the controller 100 causes the ink jet heads 1B to operate, and causes the color ink drops to be discharged to form the flushing dots on the sheet.

In the embodiment, in order to form the printing dots and the flushing dots on the medium, the ink drops are discharged by the discharge data in which the data for flushing dots is added based on the timing chart indicating the time interval for discharging the color ink drops, to the discharge data generated by the H/T processing based on the transportation speed of the sheet. However, in order to form the printing dots and the flushing dots on the medium, the aspect described below also can be assumed.

(1) Synthesized pattern data is generated by a logical sum of the flushing dot arrangement pattern to the arrangement pattern on which the H/T processing is performed, and each of the ink drop is discharged according to the synthesized pattern data as the dot data of each ink.

(2) Each of the ink drop is discharged according to the discharge data generated by performing the H/T processing which is designed such that the flushing dots are formed on the medium in the timing determined in advance, with respect to the print data.

Next, a predetermined condition to which the sheet surface FL or the non-sheet surface FL is applied will be described with reference to FIGS. 2 to 7. Details of each item in FIGS. 2 to 7 will be described below.

In FIGS. 2 to 7, as a concept of the sheet surface FL, if the time from the opening of the cap to the closing of the cap is short, the cap closing operation is performed without performing the sheet surface FL. That is because, if the cap closing operation is performed, the non-sheet surface FL may be performed and the temperature in the cap increases and the thickening does not progress. However, a case as follows will be treated as an exception.

In a case of (B-4) and (A-104), it is because viscosity of the black ink is higher than that of the color ink. In addition, in a case of (C-1), (C-2), (C-5), (C-6), (C-101), (C-102), (C-105), and (C-106), it is because the transportation speed is slow.

In addition, the number of pages to determine the sheet surface FL changes the determination threshold value according to the transportation speed. In addition, at the time of non-sheet surface FL, since the vertical moving processing of the ink jet heads (1A and 1B) non-sheet surface FL is performed, the throughput deteriorates. Therefore, as in (A-7) and (A-10), the non-sheet surface FL is avoided as much as possible. However, in the relationship with the sheet width, in a case where the sheet width is narrow as in (C-10) and (C-14) and the transportation speed is slow, non-sheet surface FL is performed. In addition, as in (C-11), (C-12), (C-15), and (C-16), in a case where both of the sheet surface FL and non-sheet surface FL are performed, the difference of the sheet width is adjusted by the amount of discharge of the non-sheet surface FL. That is because the result of printing may be affected if it is adjusted by the amount of discharge of the sheet surface FL.

As in (A-109) and (A-112), more ink is discharged at the time of color printing than at the time of monochrome printing. That is because, the amount of discharge at the time of color printing is generally more than that at the time of monochrome printing, thus the transportation speed is set to be slow considering the drying time, and more flushing is required to be performed. Moreover, in each mode in FIGS. 2 to 7, each transportation speed at the time of color printing (fast, usual, and slow) is set to be slower than each corresponding transportation speed at the time of monochrome printing (fast, usual, and slow).

FIG. 2 illustrates the flushing condition in a case where the transportation speed of the sheet is faster than usual, in the monochrome printing. In FIG. 2, since the transportation speed is faster than usual, the number of print pages of the print job to be processed is divided into two cases: a case of 1 to 3 pages and a case of 4 or more pages. In addition, in a case where the number of print pages is 4 or more pages, the case is divided into two cases: a case where the size of the sheet is equivalent to the nozzle width of the line head, that is, the printing area is the same as the entire array width of the line head (a second size), and a case where the printing area is the same as a part of the array width of the line head (a first size). Here, the case in which the transportation speed is fast or slow means a relative relationship each other.

In addition, FIG. 3, in the monochrome printing, illustrates the flushing condition in a case where the transportation speed of the sheet is usual. In FIG. 3, the number of print pages of the print job to be processed is divided into a case of 1 page and a plurality of pages.

As indicated in (B-1) in FIG. 3, in a case where the monochrome printing with respect to the sheet is designated and the number of print pages is one page, the color ink drops are not discharged from the ink jet head 1B. Therefore, the flushing dots are not formed on the sheet. On the other hand, as indicated in (B-2) and (B-3), in a case where the monochrome printing with respect to the sheet is designated and the number of print pages is a plurality of pages, the color ink drops are discharged from the ink jet head 1B, and the flushing dots are formed on the sheet.

FIG. 4, in the monochrome printing, illustrates the flushing condition in a case where the transportation speed of the sheet is slower than usual.

Similarly, FIGS. 5 to 7 illustrate the flushing condition in the color printing. FIG. 5 illustrates the flushing condition in a case where the transportation speed of the sheet is faster than usual, FIG. 6 illustrates the flushing condition in a case where the transportation speed of the sheet is usual, and FIG. 7 illustrates the flushing condition in a case where the transportation speed of the sheet is slower than usual.

In the embodiment, it is assumed that the black ink has characteristics in which the amount of moisture is less than that of the color ink. Accordingly, as indicated in (B-4) in FIG. 3 and (C-5) in FIG. 4, in a case where the printing on the sheet is designated to be performed in monochrome and to be performed only one page, the flushing dots are formed on the sheet by the black ink drops being discharged from the ink jet head 1A.

As indicated in (A-8), (A-9), (A-11), and (A-12) in FIG. 2, (C-11), (C-12), (C-15), and (C-16) in FIG. 4, and (C-111), (C-112), (C-115), and (C-116) in FIG. 7, in a case where the printing is designated to be performed with respect to the sheet of which the direction of the nozzle array of the line head is the first size, the proportion of the non-sheet surface FL to the sheet surface FL is larger than that in a case where the printing is designated to be performed with respect to the sheet of the second size in which the direction of the nozzle array of the line head is larger than that in the first size and which is the maximum size that can be designated.

In addition, as indicated in (C-1) in FIG. 4 and (C-101) in FIG. 7, in a case where the transportation speed by the transportation unit 16 is a first speed, the flushing dots are formed on the sheet by the color ink drops being discharged from the ink jet head 1B. On the other hand, in a case where the transportation speed by the transportation unit 16 is a second speed which is faster than the first speed, the color ink drops are not discharged from the ink jet head 1B. Therefore, the flushing dots are not formed on the sheet.

The information on flushing condition illustrated in FIGS. 2 to 7 is stored in the ROM as table data, and the CPU determines whether to perform the flushing or not, referring to the stored data according to necessity.

Moreover, whether the dots discharged on the sheet are printing dots or flushing dots can be determined by a method described below.

(1) In a case where the same image is printed with respect to a plurality of sheets, it may be considered as: the dots of which the ink color and the ink arrangement are common are the printing dots, and of which the ink color and the ink arrangement are not common are the flushing dots.

(2) Dots in a case where the image of (C, M, Y, K)=(X, X, X, 0) is printed in monochrome and in color are collated, and may be considered as the dots of which the ink color and the ink arrangement are common are the flushing dots, and of which the ink color and the ink arrangement are not common are the printing dots. Here, the X may be any number from zero to 255, and the value for C, M, Y and K may not be a common number. In addition, as the value becomes larger, the ink is more easily discharged to the medium.

(3) In a case where the same image is printed with respect to the sheets of which only the length in the transportation direction is different, it may be considered as the dots of which the ink color and the ink arrangement are common are the printing dots, and of which the ink color and the ink arrangement are not common are the flushing dots.

Next, FIGS. 2 to 7 will be described in detail. In (A-1) and (A-4) in FIG. 2, the printing job is finished and the cap can be closed, since the flushing can be performed during that time, the sheet surface FL is not performed. In addition, in (A-2), (A-3), (A-5), and (A-6), since the printing job is not finished, the sheet surface FL is performed. In addition, in (A-7) and (A-10), since the cap is closed after the printing job is finished, the non-sheet surface FL is not performed. In addition, in (A-8) and (A-11), since the sheet width is the same as the entire array width, the non-sheet surface FL is not performed because the sheet surface FL can be performed sufficiently. In addition, in (A-9) and (A-12), since the sheet width is not the same as the entire array width, the non-sheet surface FL is performed because the sheet surface FL cannot be performed sufficiently.

In addition, in FIG. 3, in (B-1), the cap can be closed after the printing job is finished, since the flushing can be performed during that time, the sheet surface FL is not performed. In addition, in (B-2), (B-3), (B-5), and (B-6), the printing job is not finished and the sheet surface FL is performed. In addition, in (B-4), the amount of moisture is different in the color ink and the black ink, and the sheet surface FL is performed because the sheet surface FL by the black ink is required even when the sheet surface FL by the color ink is not required. In addition, in (B-7) and (B-10), since the cap is closed after the printing job is finished, the non-sheet surface FL is not performed. In addition, in (B-8) and (B-11), since the sheet width is the same as the entire array width, the non-sheet surface FL is not performed because the sheet surface FL can be performed sufficiently. In addition, in (B-9) and (B-12), since the sheet width is not the same as the entire array width, the non-sheet surface FL is performed because the sheet surface FL cannot be performed sufficiently.

In addition, in (C-1) and (C-5) in FIG. 4, since the transportation speed is slow and flushing is likely to be performed before the printing job is finished, the sheet surface FL is performed. In addition, in (C-2), (C-3), (C-4), (C-6), (C-7), and (C-8), since the printing job is not finished, the sheet surface FL is performed. In addition, in (C-9), and (C-13), since the sheet width is the same as the entire array width, the non-sheet surface FL is not performed because the sheet surface FL can be performed sufficiently. In addition, in (C-10) and (C-14), since the sheet width is not the same as the entire array width, the non-sheet surface FL is performed because the sheet surface FL cannot be performed sufficiently. In addition, in (C-11) and (C-15), since the sheet width is the same as the entire array width and even though the sheet surface FL cannot be performed sufficiently, the sheet surface FL can be performed, thus, the non-sheet surface FL is performed less than in (C-12) and (C-16). In addition, in (C-12) and (C-16), since the sheet width is not the same as the entire array width, the non-sheet surface FL is performed more than in (C-11) and (C-15) including the portion of the sheet surface FL performed not sufficiently.

In addition, in (A-101) in FIG. 5, since the cap can be closed after the printing job is finished, if the flushing can be performed during that time, the sheet surface FL is not performed. In addition, in (A-102), (A-103), (A-105), and (A-106), the printing job is not finished and the sheet surface FL is performed. In addition, in (A-104), the amount of moisture is different in the color ink and the black ink, and the sheet surface FL is performed because the sheet surface FL by the black ink is required even when the sheet surface FL by the color ink is not needed. In addition, in (A-107) and (A-110), since the cap is closed after the printing job is finished, the non-sheet surface FL is not performed. In addition, in (A-108) and (A-111), since the sheet width is the same as the entire array width, the non-sheet surface FL is not performed because the sheet surface FL can be performed sufficiently. In addition, in (A-109) and (A-112), since the sheet width is not the same as the entire array width, the non-sheet surface FL is performed because the sheet surface FL cannot be performed sufficiently.

In (B-101) in FIG. 6, since the cap can be closed after the printing job is finished, if the flushing can be performed during that time, the sheet surface FL is not performed. In addition, in (B-102), (B-103), (B-105), and (B-106), the printing job is not finished and the sheet surface FL is performed. In addition, in (B-104), the amount of moisture is different in the color ink and the black ink, and the sheet surface FL is performed because the sheet surface FL by the black ink is required even when the sheet surface FL by the color ink is not required. In addition, in (B-107) and (B-110), since the cap is closed after the printing job is finished, the non-sheet surface FL is not performed. In addition, in (B-108) and (B-111), since the sheet width is the same as the entire array width, the non-sheet surface FL is not performed because the sheet surface FL can be performed sufficiently. In addition, in (B-109) and (B-112), since the sheet width is not the same as the entire array width, the non-sheet surface FL is performed because the sheet surface FL cannot be performed sufficiently.

In addition, in (C-101) and (C-105) in FIG. 7, since the transportation speed is slow and flushing is likely to be performed before the printing job is finished, the sheet surface FL is performed. In addition, in (C-102), (C-103), (C-104), (C-106), (C-107), and (C-108), since the printing job is not finished, the sheet surface FL is performed. In addition, in (C-109), and (C-113), since the sheet width is the same as the entire array width, the non-sheet surface FL is not performed because the sheet surface FL can be performed sufficiently. In addition, in (C-110) and (C-114), since the sheet width is not the same as the entire array width, the non-sheet surface FL is performed because the sheet surface FL cannot be performed sufficiently. In addition, in (C-111) and (C-115), since the sheet width is the same as the entire array width and even though the sheet surface FL cannot be performed sufficiently, the sheet surface FL can be performed, thus, the non-sheet surface FL is performed less than in (C-112) and (C-116). In addition, in (C-112) and (C-116), since the sheet width is not the same as the entire array width, the non-sheet surface FL is performed more than in (C-111) and (C-115) including the portion of the sheet surface FL performed not sufficiently.

Figure 8:
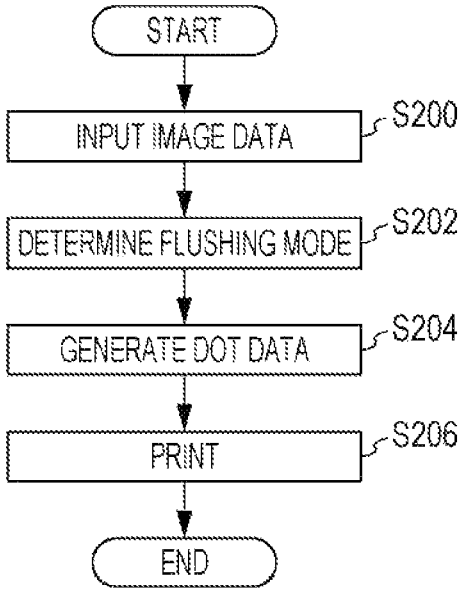
FIG. 8 is a flow chart describing the print processing of the line printer.

FIG. 8 is a flow chart describing the monochrome print processing of the line printer 10. First, an image data subject to be printed is input (STEP S200).

The CPU of the controller 100 determines the flushing mode to be executed based on the information included in the image data such as, for example, the transportation speed of the sheet based on the resolution and the number of pages to be printed, and with reference to the information on flushing conditions illustrated in FIGS. 2 to 7 (STEP S202).

The CPU of the controller 100 generates the dot data for performing the flushing according to the determined mode (STEP S204).

In generating the dot data, any method described above may be used.

Next, the CPU of the controller 100, based on the generated dot data, discharges the ink drops from the ink jet head 1A or the ink jet head 1B and prints the image with respect to the sheet, performs the flushing from the ink jet head 1A or the ink jet head 1B according to the flushing mode (STEP S206), and then ends the processing.

When the processing ends, the caps are collectively closed with respect to the ink jet head 1A and the ink jet head 1B. After the caps are closed, the ink may or may not be discharged in the caps. In any case, owing to the operation of the cap, it is possible to reduce the progress of thickening of the ink.

According to the embodiment described above, the following effects can be obtained.

(1) In the line printer 10, even in a case where the monochrome printing is performed, since the flushing for color ink is performed according to a predetermined condition, it is possible to avoid the deterioration of print quality caused by the discharging of the color ink drops being unreliable at the time of color printing due to the thickening of the color ink during the monochrome printing.

(2) Since the discharge ports of the ink jet heads 1A and 1B are collectively covered by the cap, the switching of the flushing by the color ink and the flushing by the black ink is easy. Accordingly, the throughput of the print processing can be improved and the structure of the cap can be simplified. Therefore, it is possible to minimize the line printer 10 in size and in weight.

Modification Example 1

According to the embodiment described above, in a case where the print mode determination unit 133 determines the monochrome print mode to be performed, the sheet surface FL by the color ink is instructed to be performed. However, in a case where the monochrome print mode is performed, the sheet surface FL by the black ink may be instructed to be performed in addition to the sheet surface FL by the color ink. In this case, not only the thickening of the color ink can be avoided, but also the thickening of the black ink can also be avoided. Particularly, the sheet surface FL is instructed regardless of the ink drops discharged in any frequency of the discharge data. Therefore, the thickening can be avoided significantly. In addition, even in a case where the color print mode is performed, both of the sheet surface FL by the color ink and the sheet surface FL by the black ink may be performed.

Modification Example 2

According to the embodiment and the modification example described above, the controller 100, based on the determination result by the print mode determination unit 133 whether the monochrome print mode is performed or the color print mode is performed, any of the ink drops of CMYK from the ink jet head 1A or the ink jet head 1B is selected.

However, the liquid used in printing by line printer 10 is not limited to the ink of CMYK. For example, an ink jet head may be included, which discharges functional fluid to reduce the penetration of the ink drops of CMYK to the sheet. The functional fluid may have a function of improving the concentration of the ink of CMYK by reacting with the ink of CMYK. In these cases, with respect to the ink jet heads 1A and 1B that discharge the ink drops of CMYK and an ink jet head 1C that discharges the functional fluid, the structure of the cap may be simplified by the operation of the cap mechanism 34 being collectively performed. Then, it is possible to minimize the line printer 10 in size and in weight. In collectively performing the operation of the cap, the ink jet heads 1A, 1B, and 1C are formed integrally, and all of those discharge ports may be collectively covered by the cap, or the ink jet heads 1A, 1B, and 1C are formed separately, and the opening and closing operation of the cap with respect to those ink jet heads may be collectively performed.

Furthermore, the print mode determination unit 133 determines whether the print mode using functional fluid and the ink of CMYK is performed or the print mode using the ink of CMYK without using the functional fluid is performed, and in a case where at least the latter is determined, the controller 100 may instruct the sheet surface FL by the functional fluid to be performed. In this case, the thickening of the functional fluid can be avoided. In addition, the controller 100 may instruct the non-sheet surface FL instead of all or a part of the instruction of the sheet surface FL by the functional fluid. In this case, it is possible to reduce the influence in which the functional fluid may have an affection the print result.

Modification Example 3

According to the embodiment and the modification examples described above, in a case of the monochrome print mode in which the transportation speed is fast (in the case of FIG. 2), the controller 100 changes the determination of whether or not to instruct the sheet surface FL by the color ink to be performed, according to whether the print pages (number of pages to be printed) of the printing job is three pages or less, or four pages or more. However, the threshold value of the number of pages is not limited thereto, for example, a smaller value may be set as a threshold value. In addition, the number of pages to be a threshold value may be set considering the size of the sheet in a transportation direction. Specifically, in a case of comparing the sheet having a large size in a transportation direction and a sheet having a small size, the threshold value may be set larger in the latter sheet than in the former sheet. Then, it is possible to reduce the influence in which the flushing dots have an affection on the print result. In other modes, the result may be similar.

In addition, according to the embodiment described above, in the case of monochrome print mode, the controller 100 does not instruct the sheet surface FL by the color ink to be performed for all of the three pages if the print pages of the printing job is three pages or less. However, the controller 100 may instruct the sheet surface FL by the color ink to be performed to the first and second pages, and may not instruct the sheet surface FL by the color ink to be performed to the third page. That is, the controller 100 may not instruct the sheet surface FL at least by the color ink to be performed to the third page which is a medium at least immediately before closing the cap. Of course, the controller 100 may not instruct the sheet surface FL by the color ink to be performed to the second page in addition to the third page. Furthermore, the number of pages which is a threshold value may be set considering the performing of the sheet surface FL. In this case, the number of pages which is the threshold value can be set according to the content of the printing job, and accordingly, the thickening of the fluid can be avoided. Here, the "medium immediately before" means, assuming that the sheet is a cut sheet, the sheet on which the printing is finished before the ink jet head on the print position starts to move to the maintenance position or the non-sheet surface FL position from the print position. At least one cut sheet is considered as such sheet.

Modification Example 4

According to the embodiment and the modification examples described above, in a case of the monochrome print mode in which the transportation speed is fast (in the case of FIG. 2), the controller 100 changes the determination whether or not to instruct the non-sheet surface FL to be performed, according to whether the sheet width is the same as the entire array width or a part of the array width. However, the controller 100 may change the determination whether or not to instruct the non-sheet surface FL to be performed, according to whether or not the sheet has a maximum width on which the line printer 10 can print. Specifically, if the host computer connected to the line printer 10 is capable of transmitting print data for plural types of sheet width, and if the sheet width designated by the print data is the widest width among a plural types of sheet width, the controller 100 may not instruct the non-sheet surface FL to be performed, and if the sheet width designated by the print data is not the widest width among the plural types of sheet width, the controller 100 may instruct the non-sheet surface FL to be performed. With the non-sheet surface FL not being instructed, it is possible to improve the throughput in printing of the print data.

Modification Example 5

According to the embodiment and the modification examples described above, the controller 100, by the non-sheet surface FL being performed by the discharging of the ink drops with respect to the cap or other members, selectively instructs the sheet surface FL and the non-sheet surface FL so as not to be performed at the same time. However, the controller 100, by the non-sheet surface FL being performed by the discharging of the ink drops with respect to the endless belt, non-selectively instructs the sheet surface FL and the non-sheet surface FL so as to be performed at the same time. In a case where the non-sheet surface FL is performed by the discharging of the ink drops with respect to the cap or other members, it is possible to reduce the influence in which the flushing dots have an affection on the print result.

Modification Example 6

According to the embodiment and the modification examples described above, in a case of the monochrome print mode in which the transportation speed is slow (in the case of FIG. 4), and in a case where the printing job is to print with respect to a plurality of pages, the controller 100 changes the amount of discharge of the non-sheet surface FL according to the width of the sheet. In such a case, when the width of the sheet is different from each other, the number of nozzles that can perform the sheet surface FL is also different. Therefore, in specifying the amount of discharge of the sheet surface FL, the amount of discharge of the sheet surface FL may be specified by the average amount of discharge obtained by dividing the amount discharge in which the sheet surface FL is actually performed by the total number of nozzles.

Modification Example 7

According to the embodiment and the modification examples described above, as far as the printing dots are formed by the ink jet head 1A still in the state when the cap is opened with respect to all of the ink jet heads 1A, 1B, and 1C, the cap mechanism 34 may individually perform the operation of the cap with respect to the ink jet heads 1A, 1B, and 1C, instead of the configuration in which the cap mechanism 34 collectively performs the operation of the cap. In addition, in such a case, the operation of the cap may be performed with respect to the ink jet head 1C only. In any cases, by forming the flushing dots, it is possible to avoid the thickening of the ink in the ink jet head which does not form the printing dots.

Regarding the apparatus by which the methods described above can be executed, there is a case where the methods are realized by a single apparatus, and there is a case where the methods are realized by a combination of a plurality of apparatuses, in which the apparatus includes various aspects such as a method, a program, and a medium that describes the program.

Each configuration and the combination thereof in each embodiment is an example. The modifications such as additions, omissions, substitutions, and other changes to the configuration can be made without departing from the scope of the invention. In addition, the invention is not limited by the embodiments, and is only limited by the scope of the appended claims.

What is claimed is:

1. A liquid discharge apparatus, comprising:

a transportation unit that transports a medium;

a head that includes a first nozzle array on which nozzles for discharging a first liquid are arrayed in a direction crossing the direction in which the medium is transported, and a second nozzle array on which nozzles for discharging a second liquid are arrayed in the crossing direction; and a controller that controls the transportation unit and the head based on print data, wherein, in a case where the printing of the print data is designated to be performed without forming the printing dots of the first liquid on the medium, the controller causes the head to discharge the second liquid from the second nozzle array to form the printing dots of the second liquid on the medium, and causes the head to discharge the first liquid from the first nozzle array to form the flushing dots of the first liquid on the medium.

2. The liquid discharge apparatus according to claim 1, wherein the first liquid is a color ink and the second liquid is a black ink, and wherein, in a case where the printing of the print data is designated to be performed without forming the printing dots of the color ink on the medium, the controller causes the head to discharge the black ink from the second nozzle array to form the printing dots of the black ink on the medium, and causes the head to discharge the color ink from the first nozzle array to form the flushing dots of the color ink on the medium.

3. The liquid discharge apparatus according to claim 1, wherein, in a case where the printing of the print data is designated to be performed without forming the printing dots of the first liquid on the medium and the number of pages designated to be printed is equal to or less than the predetermined number, the controller does not cause the flushing dots of the first liquid to be formed on the medium.

4. The liquid discharge apparatus according to claim 1, wherein the second liquid has characteristics of containing an amount of moisture less than that of the first liquid, and wherein, in a case where the printing of the print data is designated to be performed without forming the printing dots of the first liquid on the medium and the number of pages designated to be printed is equal to or less than the predetermined number, the controller causes the flushing dots of the second liquid to be formed on the medium.

5. The liquid discharge apparatus according to claim 1, wherein the controller does not cause the flushing dots of the first liquid to be formed on the medium of at least immediately before closing the cap with respect to the first nozzle array and the second nozzle array.

6. The liquid discharge apparatus according to claim 1, wherein the controller controls a first flushing in which the flushing dots are formed on the medium by causing the head to discharge the liquid toward the medium and a second flushing which causes the head to discharge the liquid toward a non-medium.

7. The liquid discharge apparatus according to claim 6, wherein the controller selectively controls the first flushing and the second flushing, wherein, a proportion of an amount of liquid discharged by the second flushing with respect to an amount of liquid discharged by the first flushing in a case where the printing for a first medium is designated to be performed, is larger than a proportion of an amount of liquid discharged by the second flushing with respect to an amount of liquid discharged by the first flushing in a case where the printing for a second medium is designated to be performed, and wherein a size of the first medium in the crossing direction is smaller than that of the second medium, and sizes of the both media in the transportation direction are the same.

8. The liquid discharge apparatus according to claim 1, wherein the controller changes the control of forming the flushing dots according to a speed at which the medium is transported.

9. The liquid discharge apparatus according to claim 1, wherein the controller is capable of designating whether the printing of the print data is performed in a first mode or in a second mode, wherein the first mode is a mode in which the printing dots of the second liquid are formed on the medium while the printing dots of the first liquid are not formed on the medium, and wherein the second mode is a mode in which the printing dots of the first liquid are formed on the medium and the printing dots of the second liquid are formed on the medium.

* * * * *